US006705759B1

(12) United States Patent
Kendall et al.

(10) Patent No.: US 6,705,759 B1
(45) Date of Patent: Mar. 16, 2004

(54) FAN CONTROL CIRCUIT FOR X-RAY TUBE DEVICE

(75) Inventors: Charles B. Kendall, Brookfield, WI (US); Thomas Schaefer, Milwaukee, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/065,132

(22) Filed: Sep. 19, 2002

(51) Int. Cl.[7] ..... H01J 35/10
(52) U.S. Cl. ..... 378/199; 378/127; 378/141
(58) Field of Search ..... 378/119, 127, 378/141, 199

(56) References Cited

U.S. PATENT DOCUMENTS 6,487,273 B1 * 11/2002 Takenaka et al. ..... 378/142

* cited by examiner

*Primary Examiner*—Craig E. Church
(74) *Attorney, Agent, or Firm*—Kevin G. Mierzwa

(57) ABSTRACT

An X-ray system (10) includes an X-ray tube (16) that has a temperature sensor (22) coupled thereto. The temperature sensor (22) may be included in a heat exchanger (18). The temperature sensor (22) generates a temperature signal that is provided to a controller (12). The controller (12) generates a fan speed control signal that is used to control the speed of the fan (20) in response to the temperature signal.

13 Claims, 1 Drawing Sheet

FAN CONTROL CIRCUIT FOR X-RAY TUBE DEVICE

BACKGROUND OF INVENTION

1. Technical Field

The present application relates generally to imaging systems, and more particularly, to imaging systems that use a fan as part of the cooling system.

2. Background

Various types of imaging such as CT systems use a cooling system to cool the X-ray tube. The cooling system typically employs a liquid-to-air heat exchanger to remove heat from the X-ray tube during operation. The liquid cooler typically includes a fan that is used to remove heat to the ambient air. Heat exchangers are sized for the maximum steady state capable of the X-ray tube. Many X-ray systems operate at a much lower average power for which the heat exchanger is designed. The fans of such system run at a very high speed. This high speed is much higher than necessary to remove the heat generated by the X-ray tube. Such fans are noisy and have been found to be disturbing to both patients and radiologists.

It would therefore be desirable to reduce the amount of noise during operation of an X-ray system.

SUMMARY OF INVENTION

In one aspect of the invention the X-ray system comprises an X-ray tube temperature sensor generating a temperature signal and a fan coupled to the temperature sensor. The fan has a speed that varies in response to the temperature signal.

In a further aspect of the invention, a method for operating an X-ray system comprises measuring a temperature of an X-ray tube and controlling the fan speed in response to the temperature.

One advantage of the invention is that patient comfort is increased due to the fan operating at lower speeds when the temperatures are lower. Typically the temperatures increase slowly and thus the fan speed slowly increases which makes the corresponding increase in noise less noticeable.

Other aspects and advantages of the present invention will become apparent upon the following detailed description and appended claims, and upon reference to the accompanying drawings.

DETAILED DESCRIPTION

The present invention is described with respect to a CT type system. Those skilled in the art will recognize that the present invention is also applicable to various types of X-ray systems.

Figure 1:
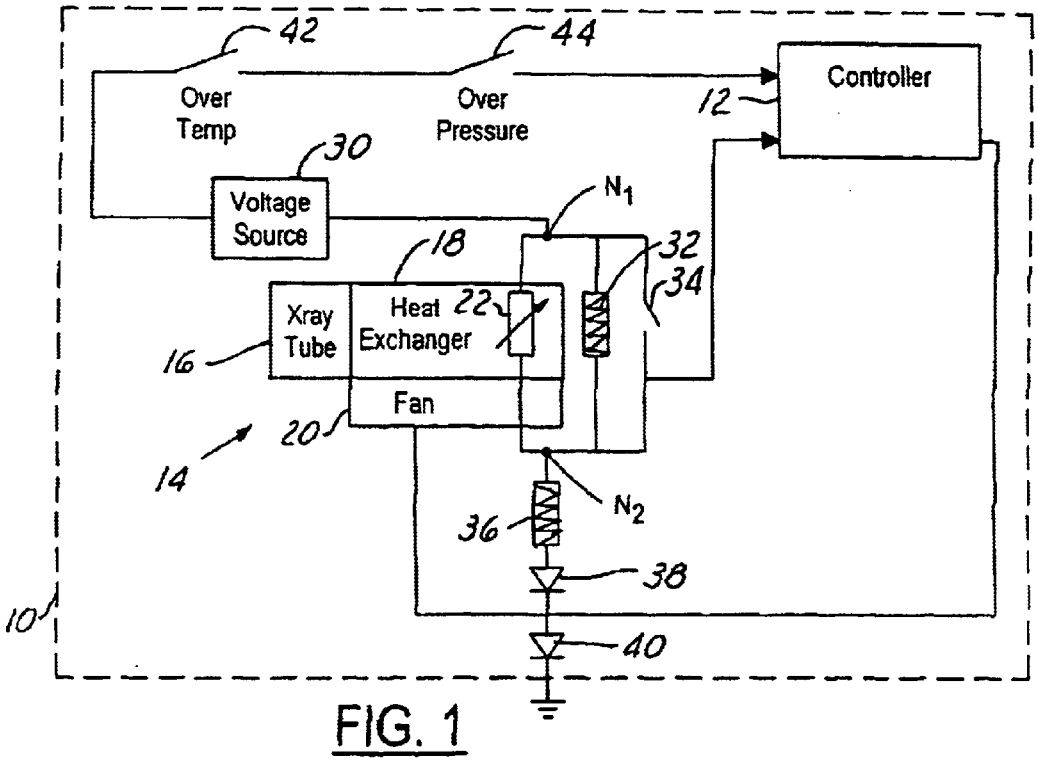
FIG. 1 is a block diagrammatic schematic view of an X-ray system having a fan control circuit according to the present invention.

Referring now to FIG. 1. an X-ray system 10 such as a CT system is illustrated. The CT system illustrated is simplified to highlight the aspects of the present invention. Those skilled in the art will recognize various other components are present in such systems. CT system 10 includes a controller 12. Controller 12 is preferably microprocessor-based. Controller 12 may be a single central controller or may be a controller specifically designed to control the operation of a cooling system 14 for an X-ray tube 16. X-ray tube 16 is thermally coupled to a heat exchanger 18. Heat exchanger 18 may be a liquid-to-air type heat exchanger typically used in X-ray systems. Heat exchanger 18 may have an integral fan or fans 20 coupled thereto. Those skilled in the art will recognize that fan 20 may also be a separate component placed adjacent to heat exchanger 18. Fan 20 is designed to help move air over the heat exchanger to cool the heat exchanger 18 and ultimately X-ray tube 16. Controller 12 is operably coupled to fan 20 to control the speed thereof.

Heat exchanger 18 may also include a thermistor 22. Thermistor 22 may actually be an integral component with heat exchanger 18. Thermistor 22 generates a temperature signal corresponding to the amount of temperature present in the heat exchanger. Thermistor 22 is coupled to a voltage source 30. Thus, the voltage change across thermistor 22 from voltage source 30 changes in response to the temperature of the heat exchanger 18. A shape resistor 32 may be positioned electrically in parallel with thermistor 22. Resistor 32 may be referred to as a shape resistor. A shunt 34 may also be positioned in parallel with the thermistor 22 and resistor 32. Thus, each of the thermistor 22, resistor 32, and shunt 34 have two common nodes $N_1$ and $N_2$. Shunt 34 is thermally controlled to close when a high temperature is sensed. That is, at temperatures above 100° C., shunt 34 may be closed. Otherwise, shunt 34 is normally open.

In series with the parallel combination of thermistor 22, resistor 32, and shunt 34, a gain resistor 36 may also be coupled to node $N_2$. Shape resistor provides a voltage devider so that controller has a proper range of controlling voltage thereto. Node $N_2$ is coupled to controller 12 to monitor the temperature signal from thermistor. Based upon the output of the temperature signal, controller 12 controls the speed of fan 20. The speed of the fan preferably varies over the temperature range except when the temperature reaches the shunt closing temperature. Also, to prevent the fan from not operating when the X-ray tube is cold, a pair of diodes 38 and 40 may be provided so that the controller constantly has some voltage and operates the fan at a minimal speed. As shown, the series connection of diodes 38 and 40 has the anode of diode 38 coupled to the gain resistor while the cathode of diode 38 is coupled to the anode of diode 40. The cathode of diode 40 is coupled to ground.

In addition, an over temperature switch 42 and an over pressure switch 44 may also be coupled to voltage source 30. Thus, if the temperature of X-ray tube 16 exceeds a certain pressure or temperature, the signal is received by controller 12. Controller 12 may also control the fan to the maximum fan speed upon the sensing of high temperature or pressure within the X-ray tube 16.

In operation, thermistor 22 generates a temperature signal responsive to the temperature within the heat exchanger 18 which directly corresponds to the temperature in X-ray tube 16. The fan speed changes in response to the temperature signal until a maximum fan speed is reached.

Figure 2:
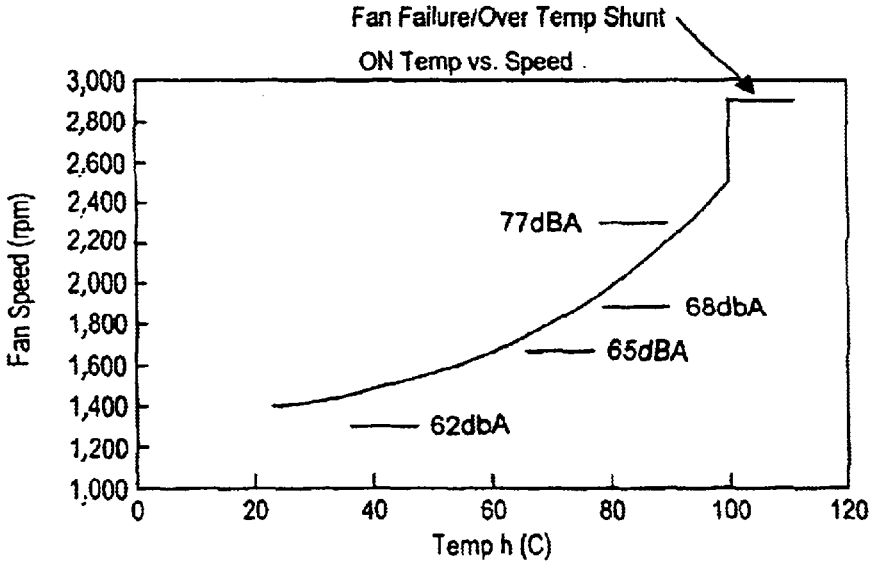
FIG. 2 is a plot of fan speed with sound levels versus temperature for the system according to the present invention.

Referring now to FIG. 2. as the temperature within the heat exchanger increases the temperature signal also changes from the thermistor 22. Thus, FIG. 2 illustrates the fan speed that changes in response to the temperature. When a predetermined temperature such as 100° is reached, the fan speed is elevated to maintain a maximum fan speed. As illustrated, the maximum fan speed is about 2900 rpm. As can be seen, the output of the controller and thus the operation of the fan is non-linear. Sound level measurements are also provided for various speeds. As speed increases sound level increases.

While the invention has been described in connection with one or more embodiments, it should be understood that the invention is not limited to those embodiments. On the contrary, the invention is intended to cover all alternatives, modifications, and equivalents, as may be included within the spirit and scope of the appended claims.

What is claimed is:

1. An X-ray system comprising:

an X-ray tube temperature sensor generating a temperature signal; and a fan coupled to said temperature sensor, said fan having a speed that varies in response to said temperature signal, said temperature sensor compring a thermistor in parallel with a shape resistor, said thermistor and shape resistor being in series with a gain resistor.

2. A system as recited in claim 1 wherein said temperature sensor has a non-linear output.

3. A system as recited in claim 1 wherein said thermistor is coupled to a heat exchanger.

4. A system a recited in claim 1 further comprising a shunt in parallel with said thermistor and said shape resistor, said shunt has an open positioned and a closed position.

5. A system as recited in claim 4 wherein said shunt is formally opened.

6. A system as recited in claim 4 wherein said shunt is thermally activated.

7. A CT system comprising:

an X-ray tube;

a heat exchanger coupled to the X-ray tube;

a temperature sensor generating a temperature signal;

a fan coupled to said temperature sensor, and a controller generating a fan speed that varies in response to said temperature signal, said temperature sensor comprising a thermistor in parallel with a shape resistor, said thermistor and shape resistor being in series with a gain resistor.

8. A system as recited in claim 7 wherein the thermistor is coupled to a heat exchanger.

9. A system as recited in claim 7 further comprising a shunt in parallel with said thermistor and said shape resistor, said shunt has an open positioned and a closed position.

10. A system as recited in claim 9 wherein said shunt is normally opened.

11. A system as recited in claim 9 wherein said shunt is thermally activated.

12. A method of operating an X-ray system comprising:

measuring a temperature of an X-ray tube;

controlling a fan speed in response to said temperature; and when a temperature reaches a predetermined temperature, maintaining a predetermined fan speed.

13. A method of operating an X-ray system comprising:

measuring a temperature of an X-ray tube; and non-linearly controlling a fan speed in response to said temperature.

* * * * *